US010507644B2

(12) United States Patent
Kawamura et al.

(10) Patent No.: US 10,507,644 B2
(45) Date of Patent: Dec. 17, 2019

(54) LIQUID EJECTING HEAD

(71) Applicant: CANON KABUSHIKI KAISHA, Tokyo (JP)

(72) Inventors: Shogo Kawamura, Kawasaki (JP); Toshiaki Hirosawa, Hiratsuka (JP); Genji Inada, Koshigaya (JP); Hiromasa Amma, Kawasaki (JP); Yasuhiko Osaki, Kamakura (JP); Takuya Iwano, Inagi (JP); Shin Ishimatsu, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/957,593

(22) Filed: Apr. 19, 2018

(65) Prior Publication Data

US 2018/0304620 A1 Oct. 25, 2018

(30) Foreign Application Priority Data

Apr. 21, 2017 (JP) ..... 2017-084780

(51) Int. Cl.
*B41J 2/14* (2006.01)
*B41J 2/045* (2006.01)
*B41J 2/155* (2006.01)

(52) U.S. Cl.
CPC ..... *B41J 2/045* (2013.01); *B41J 2/14072* (2013.01); *B41J 2/14201* (2013.01); *B41J 2/155* (2013.01); *B41J 2002/14491* (2013.01); *B41J 2202/20* (2013.01); *B41J 2202/21* (2013.01)

(58) Field of Classification Search
None
See application file for complete search history.

(56) References Cited

U.S. PATENT DOCUMENTS 7,171,748 B2 * 2/2007 Kigami ..... B41J 2/14072 29/831
7,533,960 B2 * 5/2009 Yasuda ..... B41J 2/14072 347/40
2011/0292125 A1 * 12/2011 Abe ..... B41J 2/14072 347/44
2014/0022305 A1 * 1/2014 Kida ..... B41J 2/14314 347/50

FOREIGN PATENT DOCUMENTS

JP 2001-322274 A 11/2001

* cited by examiner

*Primary Examiner* — Matthew Luu
*Assistant Examiner* — Tracey M McMillion
(74) *Attorney, Agent, or Firm* — Canon U.S.A., Inc. I.P. Division

(57) ABSTRACT

A liquid ejecting head including a print element substrate including an ejection opening for ejecting a liquid, a wiring member including wiring electrically connected to the print element substrate, a connection electrically connecting the print element substrate to the wiring member, a support member supporting the wiring member, a sealing material sealing the connection, and a cover member provided on the support member. In the liquid ejecting head, the wiring member is a strip-shaped member, and a portion of the wiring member provided on a surface of the support member that supports the wiring member is covered by the sealing material and the cover member.

17 Claims, 14 Drawing Sheets

LIQUID EJECTING HEAD

BACKGROUND OF THE INVENTION

Field of the Invention

The present disclosure relates to a liquid ejecting head, a representative example of which is an ink jet system applied to a printing apparatus that performs a print operation by ejecting a recording liquid, such as ink.

Description of the Related Art

Previously, as a generally known liquid ejecting head, there is a liquid ejecting head, a representative example of which is an ink jet system, in which a flexible wiring substrate, such as a TAB film, is electrically connected to a print element substrate. An electric connection that establishes electric connection through inner lead bonding, wire bonding, or the like is covered by a sealing material that is formed of, as the main component, epoxy resin that has ink resistance properties, so that trouble such as ink becoming adhered to the electric connection is prevented. For example, in a TAB film, a copper wiring body is formed by patterning on a base film formed of polyimide film and, furthermore, the wiring is protected by a cover film, such as an aramid film. In some cases, surface modification through plasma treatment is performed on the polyimide film and the aramid film to improve adhesive strength between the films and the sealing material.

As described in Japanese Patent Laid-Open No. 2001-322274, there a technique for preventing adhesion of ink to an electric connection by covering the electric connection by having the size of the nozzle plate larger than that of an actuator member provided with an electrode.

However, in the technique set forth in Japanese Patent Laid-Open No. 2001-322274, a sealing material, such as an epoxy resin, is cured between an actuator substrate that includes an electric connection and a nozzle plate; accordingly, due to the difference in linear expansion coefficient, a warp is formed on the nozzle plate, and the printing quality may become deteriorated. Accordingly, the sealing resin that can be used is limited to one that has relatively low viscosity, such as a two-liquid-mixed adhesive agent having a low curing temperature, or an ultraviolet cure adhesive.

SUMMARY OF THE INVENTION

The present disclosure provides, in a liquid ejecting head using a flexible wiring member and a thermosetting sealing material, a liquid ejecting head in which invasion of ink to the electric connection is suppressed and which has high electrical reliability.

An aspect of the present disclosure is a liquid ejecting head including a print element substrate including an ejection opening for ejecting a liquid, a wiring member including wiring electrically connected to the print element substrate, a connection electrically connecting the print element substrate to the wiring member, a support member supporting the wiring member, a sealing material sealing the connection, and a cover member provided on the support member. In the liquid ejecting head, the wiring member is a strip-shaped member, and a portion of the wiring member provided on a surface of the support member that supports the wiring member is covered by the sealing material and the cover member.

Furthermore, an aspect of the present disclosure is a liquid ejecting head including a print element substrate including an ejection opening for ejecting a liquid, a wiring member including wiring electrically connected to the print element substrate, a connection electrically connecting the print element substrate to the wiring member, and a support member supporting the wiring member, in which a portion of the wiring member provided on a surface of the support member that supports the wiring member is provided on the support member without being exposed.

Further features of the present disclosure will become apparent from the following description of exemplary embodiments with reference to the attached drawings.

DESCRIPTION OF THE EMBODIMENTS

First Exemplary Embodiment

Hereinafter, examples of embodiments will be described with reference to the drawings. Note that the following description does not limit the scope of the present disclosure.

In the exemplary embodiments, while a thermal method that ejects liquid by creating an air bubble in the liquid with a heat generating element is employed as an example, the present disclosure can be used in liquid ejecting heads employing a piezoelectric method and other various liquid ejecting methods. Note that other than typical printing devices, the present disclosure can be applied to devices such as a copy machine, a fax machine including a communication system, a word processor including a printing unit, and the like, and further can be applied to industrial printing apparatuses in which devices that perform various processes are combined.

Figure 1:
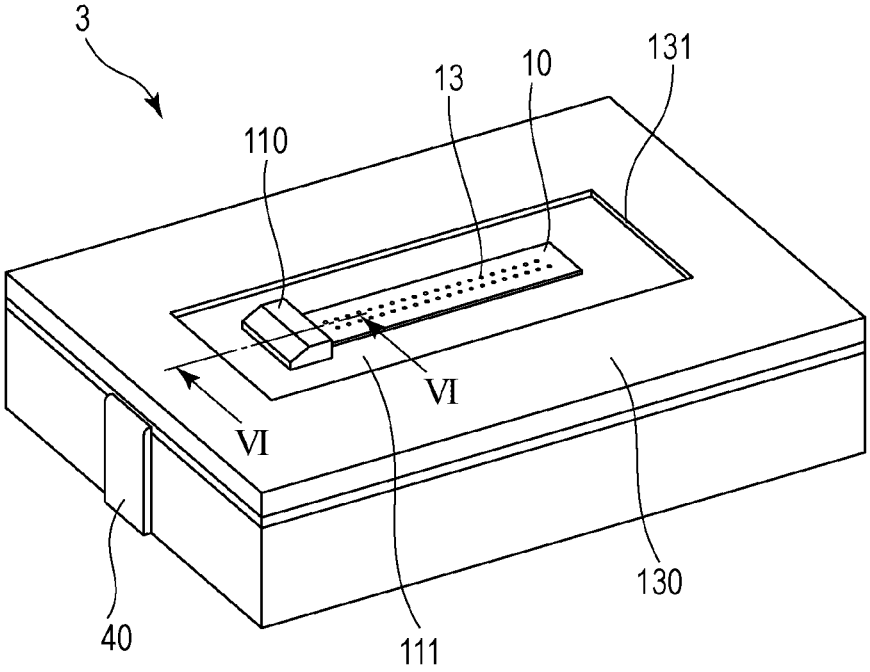
FIG. 1 is a perspective view illustrating a liquid ejecting head of a first exemplary embodiment.
Figure 2:
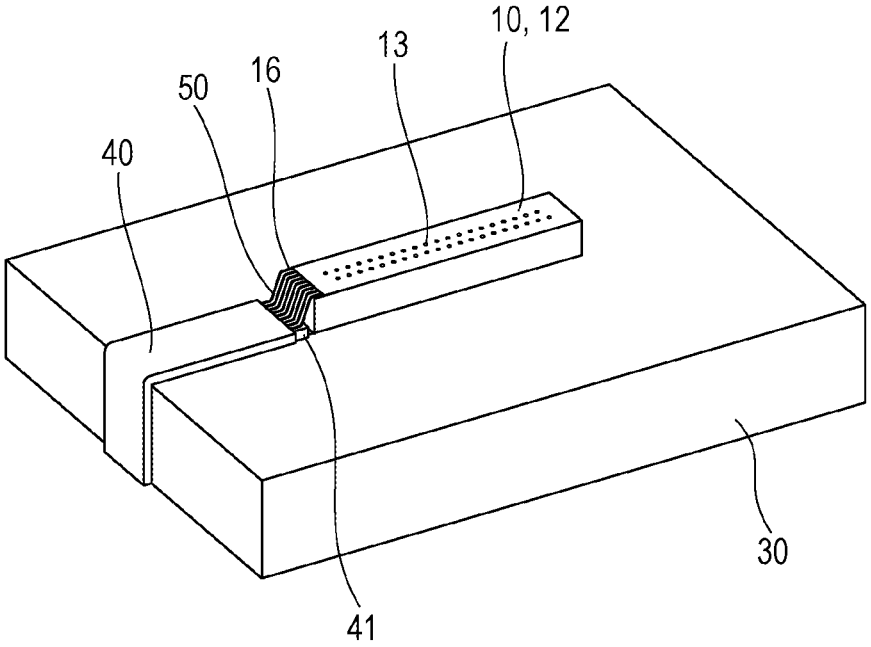
FIG. 2 is a perspective view illustrating a manufacturing process of the liquid ejecting head of the first exemplary embodiment.
Figure 3:
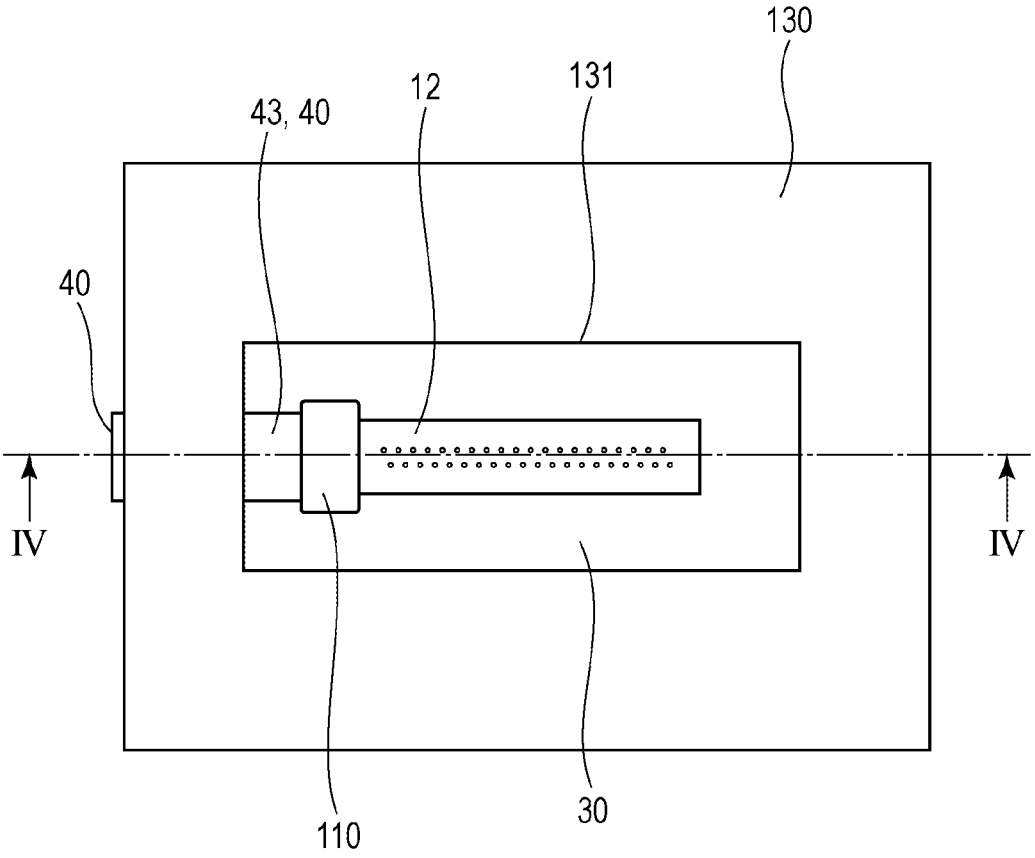
FIG. 3 is a top view illustrating the manufacturing process of the liquid ejecting head of the first exemplary embodiment.
Figure 4:
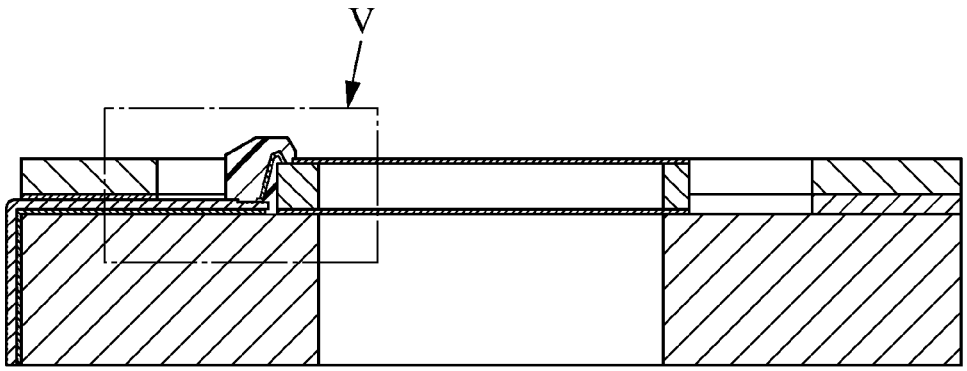
FIG. 4 is a cross-sectional view taken along line IV-IV in FIG. 3.
Figure 5:
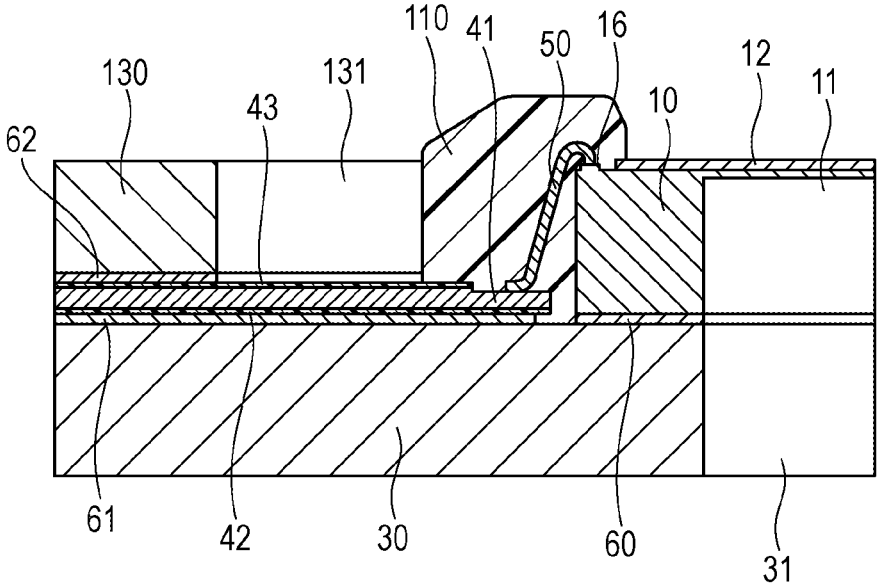
FIG. 5 is an enlarged view of a portion V in FIG. 4.
Figure 6:
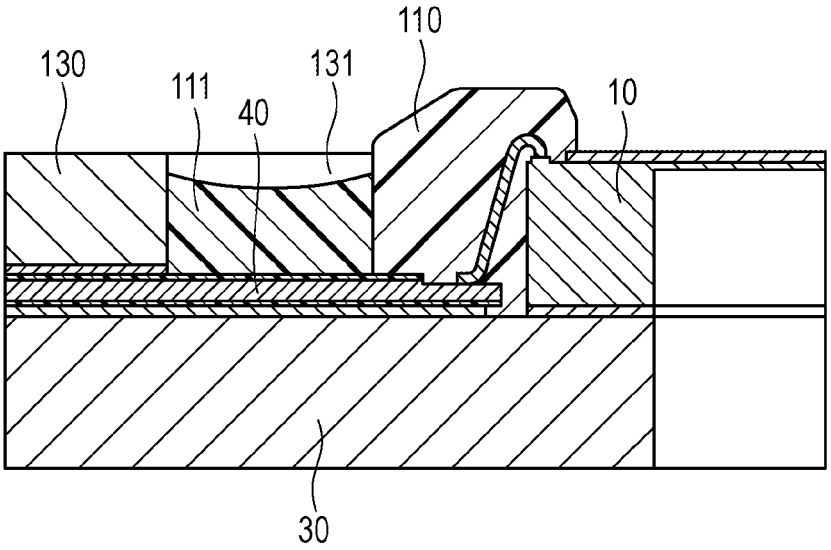
FIG. 6 is an enlarged view of a cross section of a portion taken along line VI-VI in FIG. 1.

A configuration of a liquid electing head according to a first exemplary embodiment will be described. FIG. 1 is a perspective view of the liquid ejecting head according to the present exemplary embodiment. FIG. 2 is a perspective view illustrating a manufacturing process of the liquid ejecting head, FIG. 3 is a top view of the liquid ejecting head during the manufacturing process, FIG. 4 is a cross-sectional view taken along line IV-IV in FIG. 3, FIG. 5 is an enlarged view of a portion V in FIG. 4. Furthermore, FIG. 6 is an enlarged view of a cross section of a portion taken along line VI-VI in FIG. 1.

As illustrated in FIG. 1, a liquid ejecting head 3 is a liquid ejecting head in which a print element substrate 10 that ejects a liquid, such as ink, is disposed at the center. As illustrated in FIG. 2, the print element substrate 10 is disposed on a support member 30, and a strip-shaped flexible wiring substrate 40 that is a wiring member that imparts drive signals and the like from a main body of the printing apparatus is electrically connected thereto.

In the print element substrate 10, an electric circuit and a heat generating resistor are formed on a silicon substrate having a thickness of about 0.6 to 0.8 mm, and an ejection opening forming member 12 provided with ejection openings 13 is layered on the silicon substrate. A terminal 16 electrically connected to the flexible wiring substrate 40 is provided on a first end side of a surface of the silicon substrate. The support member 30 includes a liquid communication port 31 that supplies ink to the print element substrate 10 and is adhered and fixed to the print element substrate 10 with a first adhesive agent 60 so that the liquid communication port 31 is in communication with the flow path 11 provided on a back surface of the print element substrate 10.

In the flexible wiring substrate 40, a copper wiring body having a thickness of 0.01 to 0.02 mm is formed by patterning on a polyimide base film 42 having a thickness of 0.025 to 0.050 mm. Furthermore, a terminal 41 that establishes an electric connection to the print element substrate 10 is formed at an end portion of the flexible wiring substrate 40. Other than the portion that becomes the terminal 41, the flexible wiring substrate 40 is covered with a polyimide or aramid cover film 43 having a thickness of 0.004 to 0.050 mm to prevent corrosion. Gold plating is deposited on the terminal 41 to prevent corrosion. In the flexible wiring substrate 40, a surface of the base film 42 is adhered and fixed on an upper surface of the support member 30 with a second adhesive agent 61. The flexible wiring substrate 40 is provided from the upper surface to a lateral surface of the support member 30 that is adjacent to the upper surface.

The terminal 16 on the print element substrate 10, and the terminal 41 provided on the first end side of the flexible wiring substrate 40 in a longitudinal direction are electrically connected to each other by wire bonding. Furthermore, as illustrated in FIGS. 3, 4, and 5, the electric connection is covered and sealed with a first sealing material 110.

The first sealing material 110 seals a portion from the ejection openings forming member 12 provided on the main surface of the print element substrate 10 to the cover film 43 of the flexible wiring substrate 40 so as to cover gold wires 50 of the electric connection. A thermosetting epoxy resin that has high elasticity (1 GPa or more) to protect the electric connection from external force and that has high viscosity so that the thermosetting epoxy resin does not flow out to the ejection openings 13 side and so that the coated shape is stable is used for the first sealing material 110.

A plate-shaped cover member 130 that surrounds the edge portion of the support member 30 on the ejection opening surface side and that is provided with an opening 131 is adhered and fixed to the support member 30 with a third adhesive agent 62 so as to form a dam. A height of the surface of the cover member 130 is substantially the same as that of the print element substrate 10. As illustrated in FIGS. 1 and 6, a second sealing material 111 is filled between the opening 131 of the cover member 130 and the print element substrate 10, so that the flexible wiring substrate 40 becomes buried. The first sealing material 110 is provided so as to protrude from a surface of the second sealing material 111.

The cover member 130 functions as a contact surface of a cap member that caps the liquid ejecting head 3 during recording standby. Accordingly, it is desirable that a sealing material, a filling material, or the like be applied in the opening 131, and asperities of an ejection opening surface and gaps be filled so that a closed space is formed when capping is performed.

A two-liquid-mixed rubber-modified epoxy resin that has low elasticity (0.01 GPa or less) and that can be cured at normal temperature is used as the second sealing material 111 and is filled in a shallow area where the upper portion is open; accordingly, external pressure is not easily applied to the print element substrate 10 and the components around the print element substrate 10.

Accordingly, including the portion that is electrically connected to the print element substrate 10, substantially, the entire flexible wiring substrate 40 on the ejection opening surface side in the liquid ejecting head 3 is covered by the cover member 130, the first sealing material 110, and the second sealing material 111. In other words, the portion of the flexible wiring substrate 40 provided on the upper surface of the support member 30 is, without being exposed to the outside, covered by the cover member 130 and the sealing material. While two types of sealing materials are used in the present exemplary embodiment, not limited to the above, the flexible wiring substrate 40 may be covered by a single sealing material. In the configuration of the present exemplary embodiment, a liquid such as ink or the like does not easily enter the electric connection, and the electrical reliability can be improved.

Second Exemplary Embodiment

Figure 7:
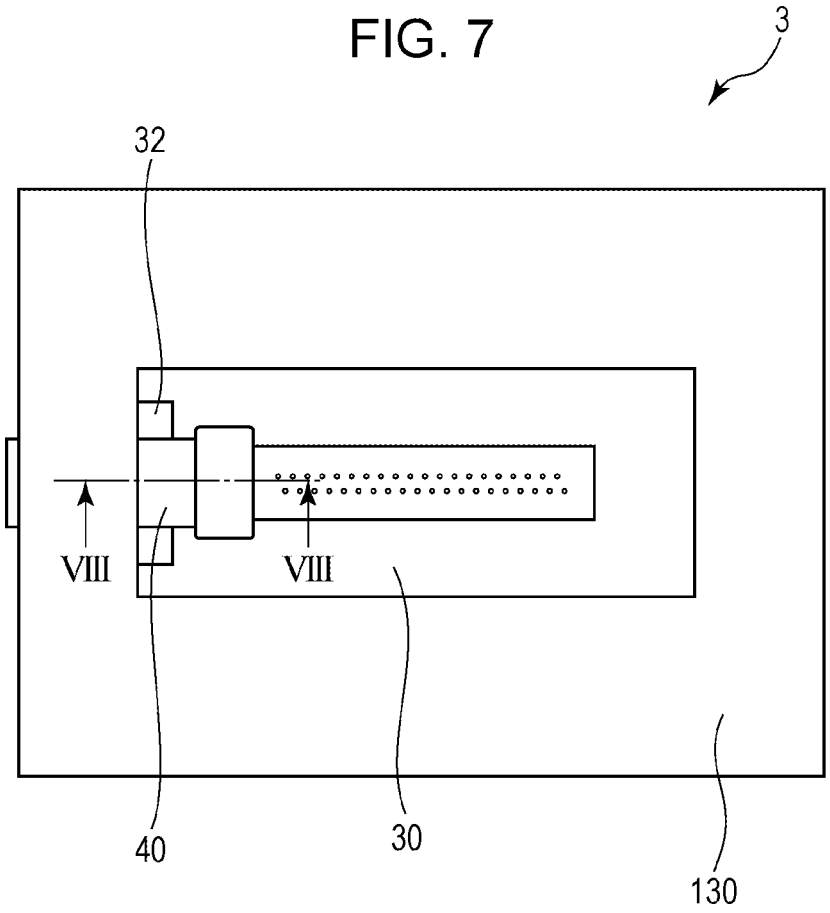
FIG. 7 is a top view illustrating a liquid ejecting head of a second exemplary embodiment.
Figure 8:
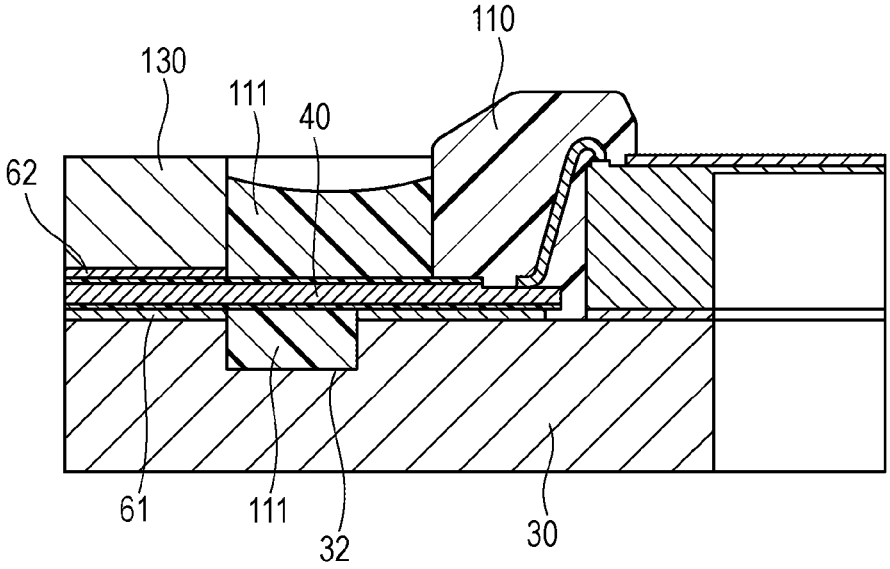
FIG. 8 is an enlarged view of a cross section of a portion taken along line VIII-VIII in FIG. 7.

FIG. 7 is a top view of a liquid ejecting head for describing a liquid ejecting head of a second exemplary embodiment, and is a diagram in which, for the sake of description, the second sealing material 111 is seen through. FIG. 8 is an enlarged view of a cross section of a portion taken along line VIII-VIII in FIG. 7 and illustrates the second sealing material 111.

As illustrated in FIG. 7, in the second exemplary embodiment, the support member 30 is provided with a groove 32 formed below an intermediate portion of the flexible wiring substrate 40 on the ejection opening surface side and wider than the width of the flexible wiring substrate 40. Owing to the groove 32, the second sealing material 111 filled in the dam seals both surfaces of a portion of the flexible wiring substrate 40 from the front side and the rear side.

Adhesive strength of a portion where a plurality of types of material are adhered to each other in a complex manner may decrease due to the difference in linear expansion coefficient. For example, the flexible wiring substrate 40 interposed between the cover member 130 and the support member 30 has a portion adhered by the second adhesive agent 61 and the third adhesive agent 62. However, as in the present exemplary embodiment, a decrease in the adhesive strength is prevented by creating a portion adhered only by the second sealing material 111 in an area of the flexible wiring substrate 40 including the electric connection. With the above, even when ink adheres to a lateral surface of the liquid ejecting head, ink invasion into the electric connection can be made difficult.

Third Exemplary Embodiment

Figure 9:
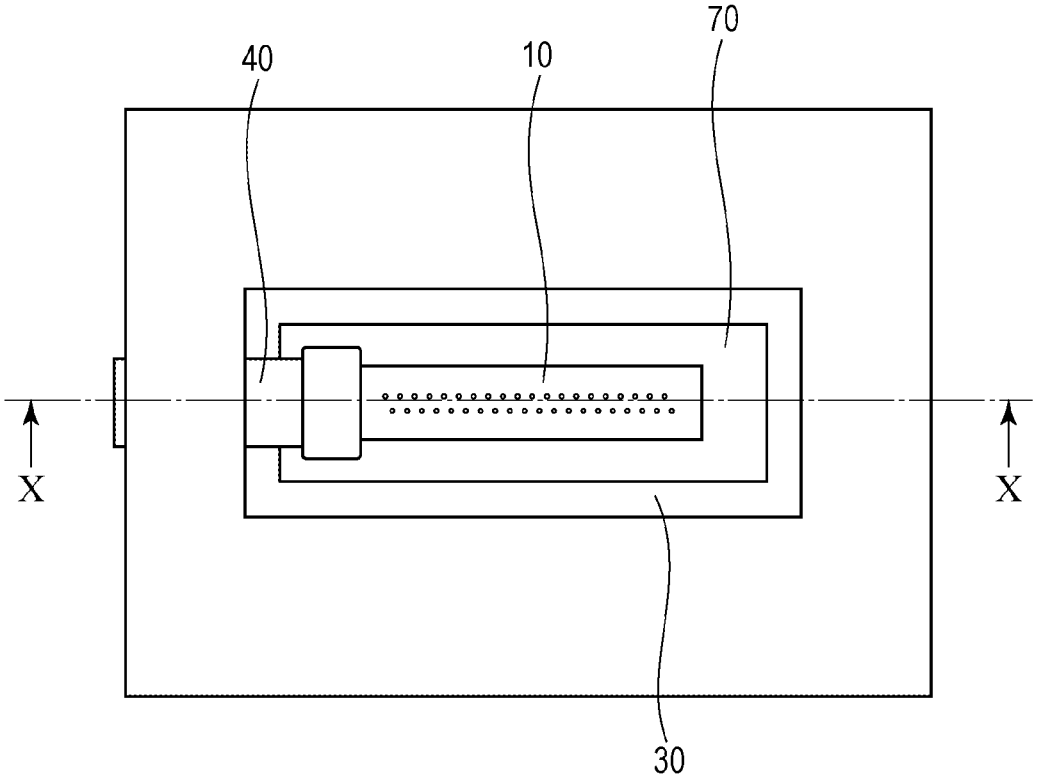
FIG. 9 is a top view illustrating a liquid ejecting head of a third exemplary embodiment.
Figure 10:
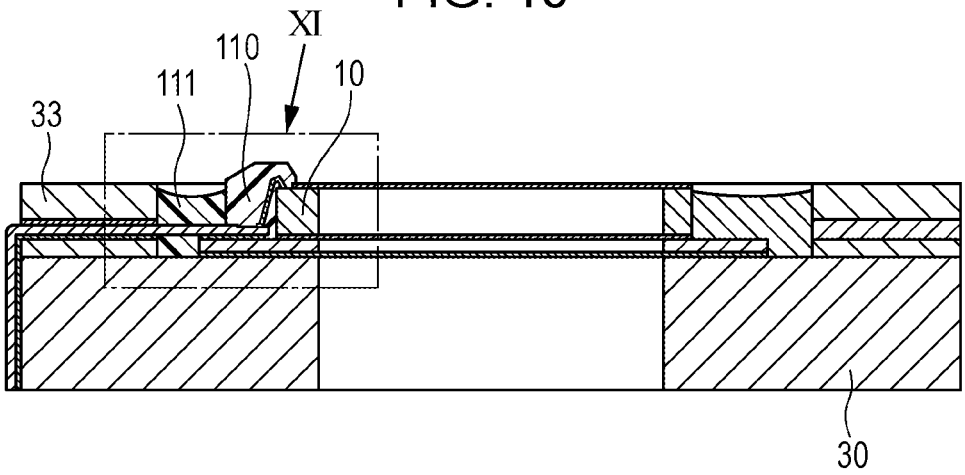
FIG. 10 is a cross-sectional view taken along line X-X in FIG. 9.
Figure 11:
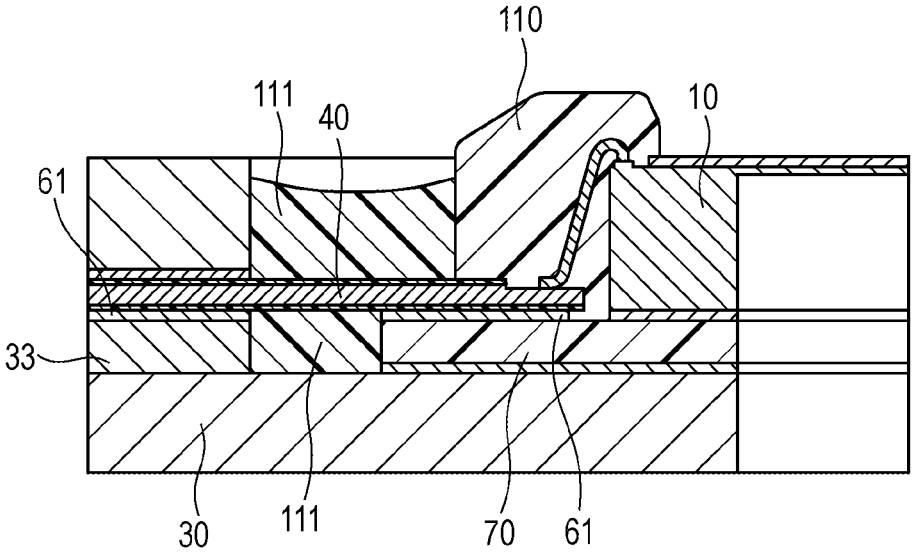
FIG. 11 is an enlarged view of a portion XI in FIG. 10.

FIG. 9 is a top view of a liquid ejecting head for describing a liquid ejecting head of a third exemplary embodiment, and is a diagram in which, for the sake of description, the second sealing material 111 is seen through. FIG. 10 is a cross-sectional view taken along line X-X in FIG. 9, and is a diagram illustrating the second sealing material 111. Furthermore, FIG. 11 is an enlarged view of a portion XI in FIG. 10.

As illustrated in FIG. 9, in the third exemplary embodiment, the print element substrate 10 is adhered and fixed to a support plate 70 provided on the support member 30. The support plate 70 is not only a supporting member that supports the print element substrate 10 but also is a flow path member that fluidly communicates the print element substrate 10 and the support member 30 to each other. The material of the support plate 70 is, desirably, alumina or a resin material, for example.

The support member 30 includes an edge portion 33 that surrounds the support plate 70. A height of the edge portion 33 is configured so as to be substantially the same as the height of the support plate 70 that is adhered and fixed to the support member 30, and a groove is formed between the edge portion 33 and the support plate 70. The flexible wiring substrate 40 is fixed with the second adhesive agent 61 so that the portion where the electric connection is made with the print element substrate 10 is on the support plate 70 and, furthermore, is fixed to the edge portion 33 with the second adhesive agent 61 as well so that the flexible wiring substrate 40 extends to the lateral surface of the liquid ejecting head. The edge portion 33 and the support member 30 may be formed integrally.

The groove formed between the edge portion 33 and the support plate 70 exerts an effect similar to that of the groove of the second exemplary embodiment. In other words, a portion of the flexible wiring substrate 40 is sealed from both surfaces on the front and back with the second sealing material 111 throughout the entire periphery; accordingly, the invasion of ink into the electric connection can be made difficult.

Fourth Exemplary Embodiment

Figure 12:
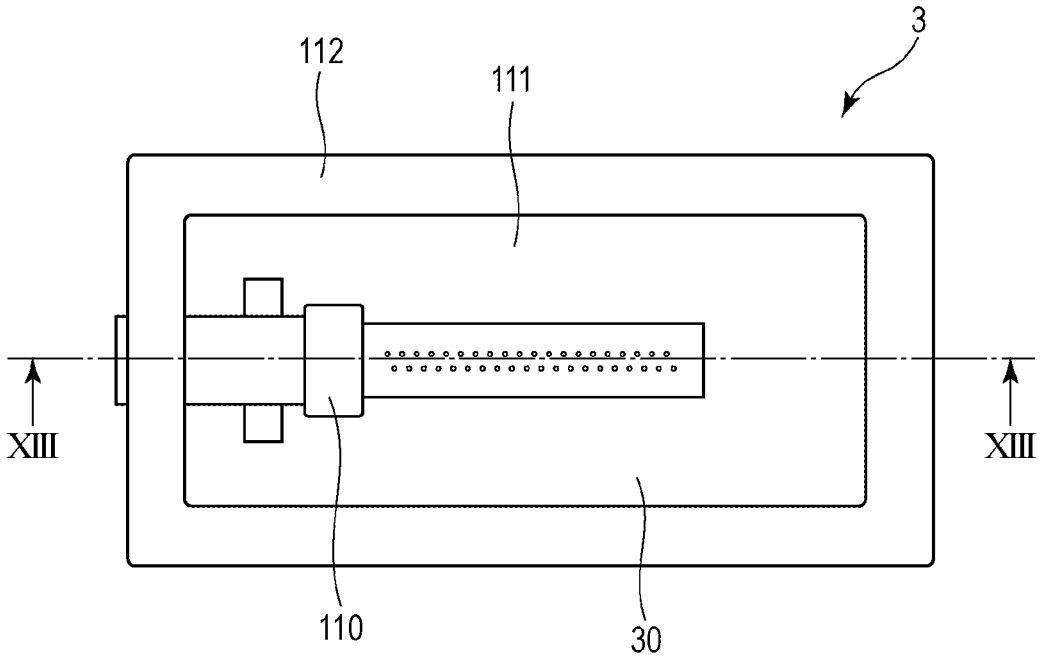
FIG. 12 is a top view illustrating a liquid ejecting head of a fourth exemplary embodiment.
Figure 13:
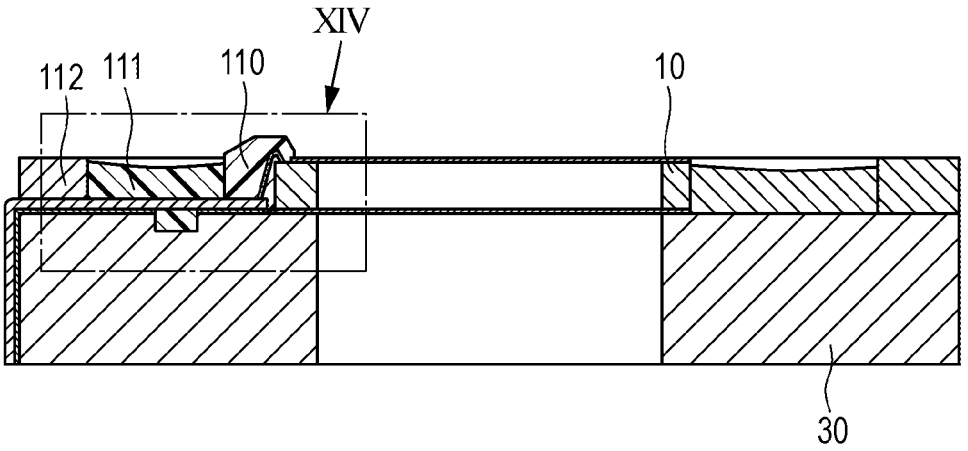
FIG. 13 is a cross-sectional view taken along line XIII-XIII in FIG. 12.

FIG. 12 is a top view of a liquid ejecting head for describing a liquid ejecting head of a fourth exemplary embodiment, and is a diagram in which, for the sake of description, the second sealing material 111 is seen through. FIG. 13 is a cross-sectional view taken along line XIII-XIII in FIG. 12, and is a diagram illustrating the second sealing material 111. Furthermore, FIG. 14 is an enlarged view of a portion XIV in FIG. 13.

As illustrated in FIG. 12, in the fourth exemplary embodiment, a dam is formed at an edge portion of the liquid ejecting head 3 on the ejection opening surface side with a third sealing material 112. A material that has high viscosity that allows the coating shape to be stable is used for the third sealing material 112 to form the shape that is similar to the shape of the cover member described above. Since the shape is formed by coating, the adhesive agent for the cover member is not needed.

Figure 14:
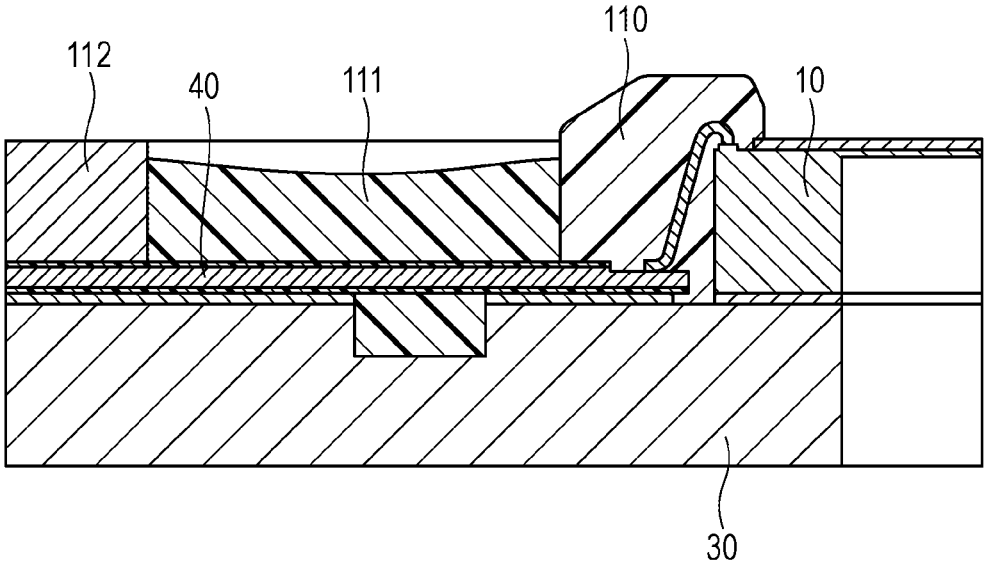
FIG. 14 is an enlarged view of a portion XIV in FIG. 13.

As illustrated in FIGS. 12 and 14, the second sealing material 111 is filled between the third sealing material 112 and the print element substrate 10 so that the flexible wiring substrate 40 is buried. With the above configuration as well, the electrical reliability can be improved in a similar manner to that of the exemplary embodiments described above.

Fifth Exemplary Embodiment

Figure 15:
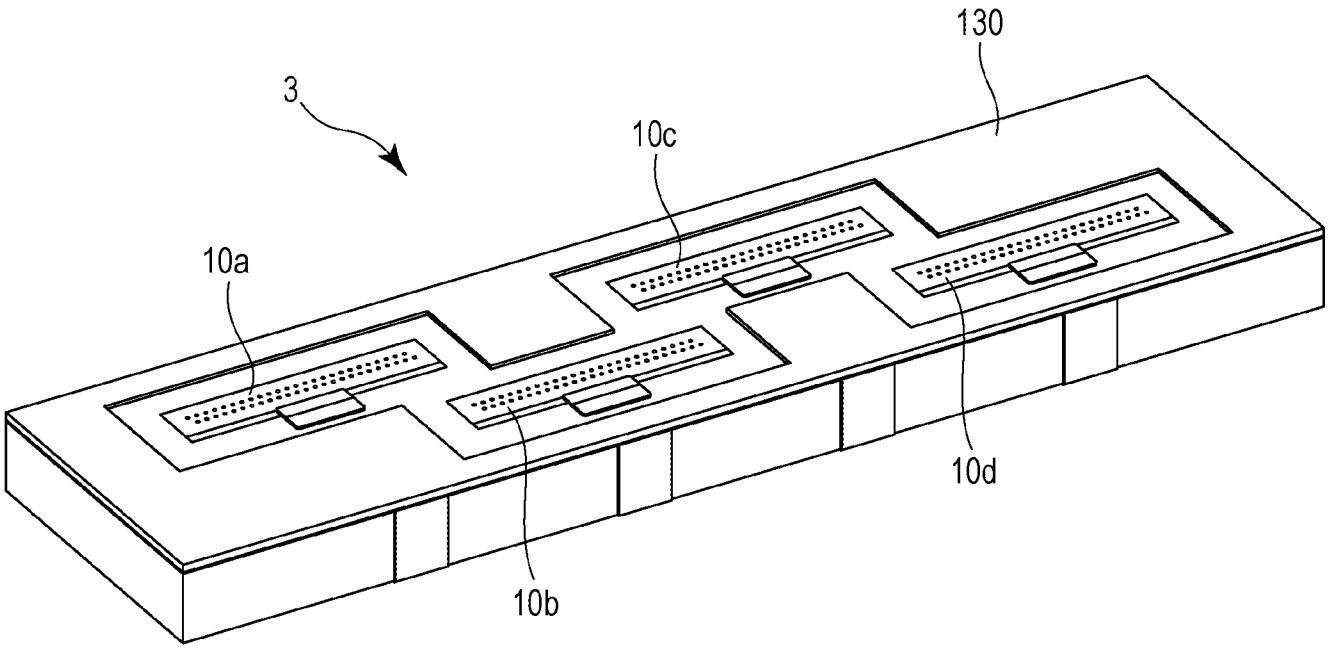
FIG. 15 is a perspective view illustrating a liquid ejecting head of a fifth exemplary embodiment.
Figure 16:
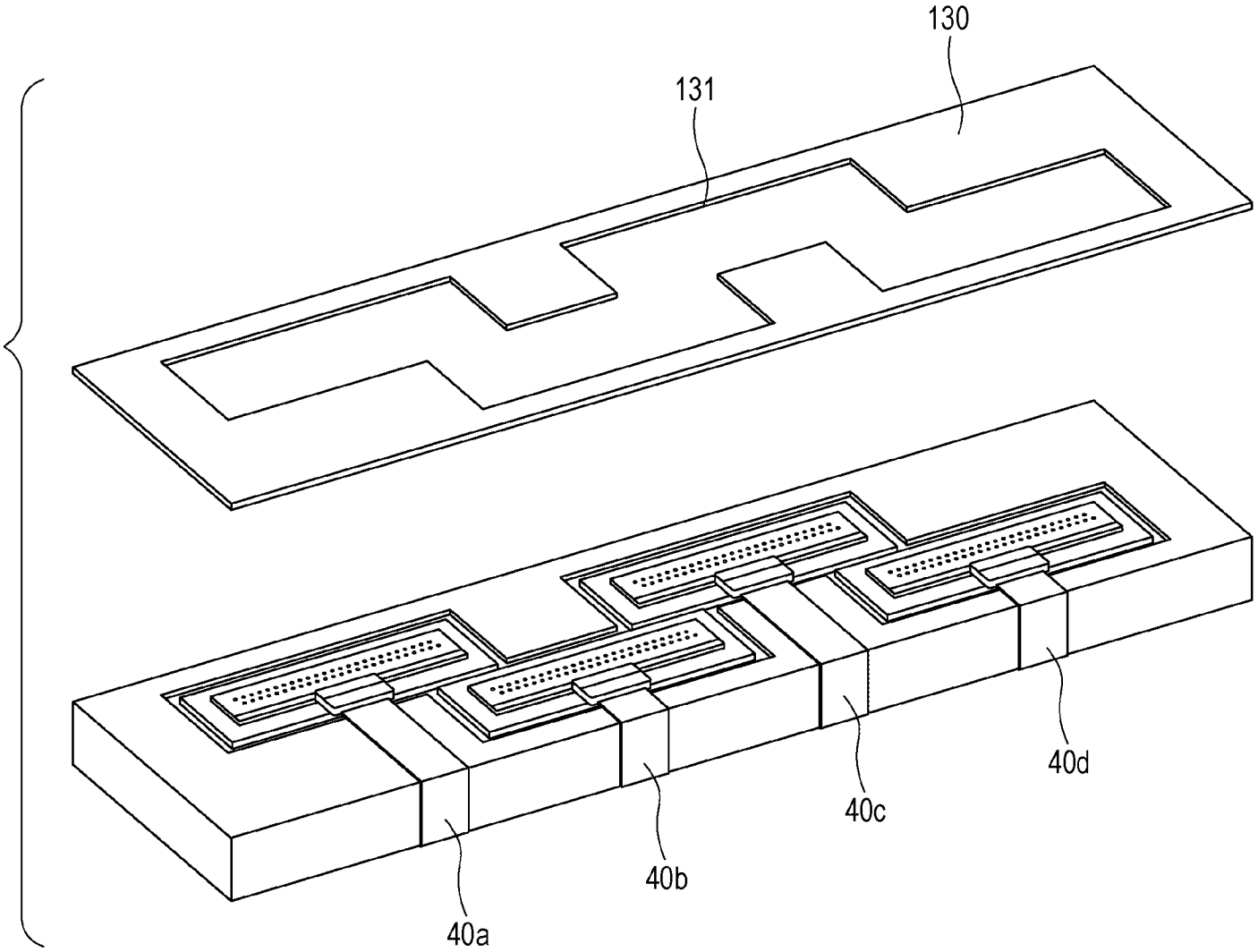
FIG. 16 is a perspective view of the liquid electing head of the fifth exemplary embodiment in a disassembled state.

FIG. 15 is a perspective view illustrating a liquid ejecting head of a fifth exemplary embodiment, and FIG. 16 is a perspective view of the liquid ejecting head in a disassembled state. A liquid ejecting head of the fifth exemplary embodiment is a so-called page wide liquid electing head provided with a length that corresponds to the width of the printing medium. As illustrated in FIG. 15, a plurality of print element substrates 10*a*, 10*b*, 10*c*, and 10*d* are disposed in a staggered manner in the liquid ejecting head 3. Furthermore, as illustrated in FIG. 16, the liquid ejecting head includes a plurality of flexible wiring substrates 40*a*, 40*b*, 40*c*, and 40*d*. Furthermore, the cover member 130 is provided with a single opening having a shape that matches the shapes of the print element substrates disposed in a staggered manner. The plurality of print element substrates are provided inside the opening. A contact for electrically connecting each print element substrate 10 to the corresponding flexible wiring substrate 40 is provided in the edge of the relevant print element substrate 10 extending in the longitudinal direction. Furthermore, the second sealing material 111 is filled between the cover member 130 and the print element substrates 10*a*, 10*b*, 10*c*, and 10*d* to bury the flexible wiring substrates 40*a*, 40*b*, 40*c*, and 40*d*.

Since a single opening 131 is formed for a plurality of print element substrates, the amount of second sealing material 111 applied to each print element substrate becomes consistent without the amount varying at each position in the print element substrates. As in the page wide liquid ejecting head of the present exemplary embodiment, in a configuration including a plurality of print element substrates 10, the number of electric connections increase; accordingly, application of the present disclosure is especially preferable.

Sixth Exemplary Embodiment

Figure 17:
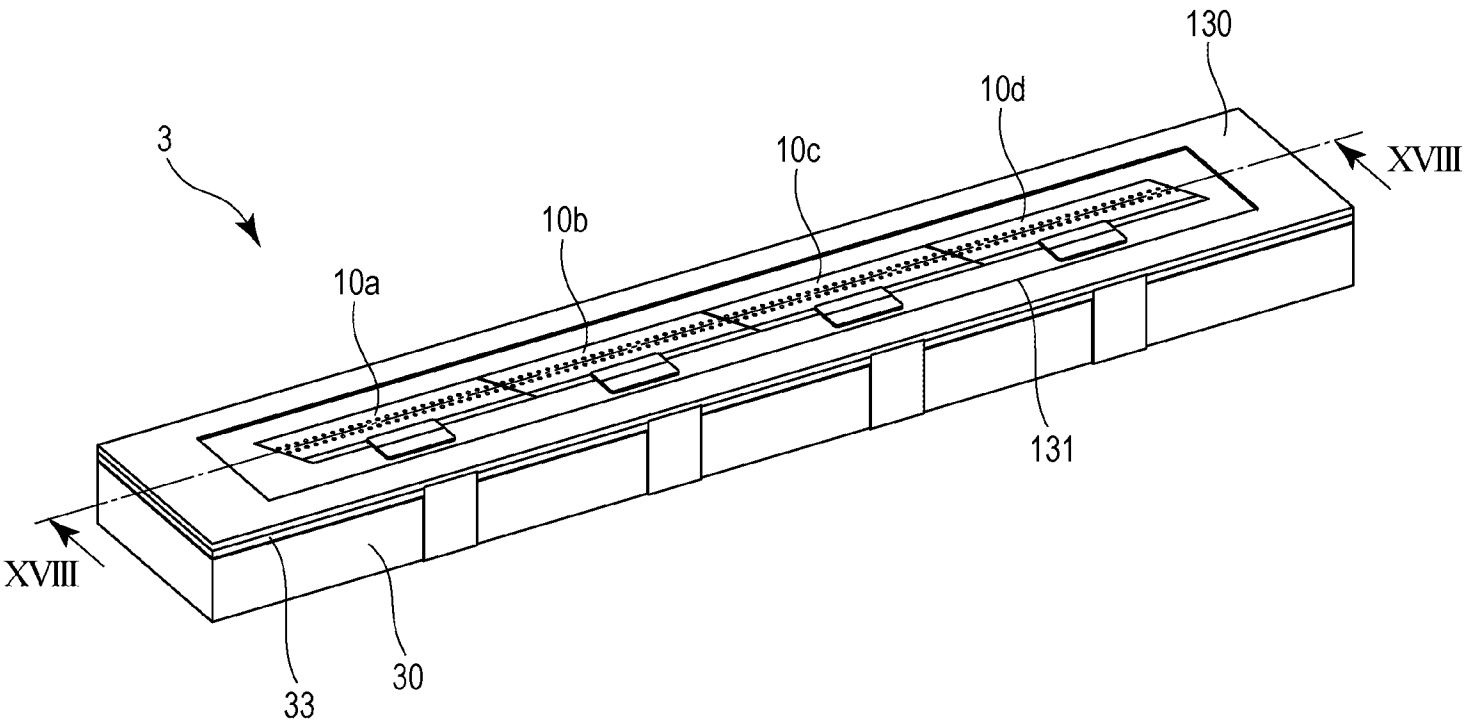
FIG. 17 is a perspective view illustrating a liquid ejecting head of a sixth exemplary embodiment.
Figure 18:
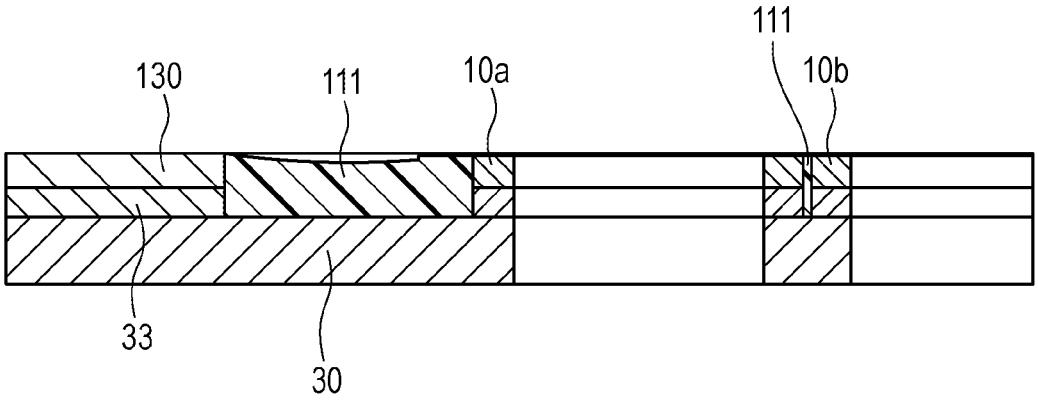
FIG. 18 is an enlarged view of a cross section of a portion taken along line XVIII-XVIII in FIG. 17.

FIG. 17 is a perspective view illustrating a liquid ejecting head of a sixth exemplary embodiment, and FIG. 18 is an enlarged view of a cross section of a portion taken along line XVIII-XVIII in FIG. 17. The sixth exemplary embodiment similar to the fifth exemplary embodiment relates to a page wide liquid ejecting head, and as illustrated in FIG. 17, a plurality of print element substrates 10*a*, 10*b*, 10*c*, and 10*d* are disposed in a straight line.

A plurality of print element substrates are disposed in a single opening 131 of the cover member 130 and a frame formed by the edge portion 33 of the support member 30 so that the ejection openings are adjacent to each other in a column direction of the ejection openings. Furthermore, the second sealing material is filled between the cover member 130 and the plurality of print element substrates 10*a*, 10*b*, 10*c*, and 10*d*, so that the flexible wiring substrates on the ejection opening surface side are buried.

Since a sealing material that has low viscosity is used as the second sealing material 111 filled around the print element substrates, as illustrated in the cross-sectional view in FIG. 18, the second sealing material 111 also filled in the gap between the print element substrates 10*a* and 10*b* disposed adjacent to each other. The present exemplary embodiment is capable of reducing the size of the liquid ejecting head by arranging the plurality of print element substrates 10 in a straight line. Accordingly, the intervals between the electric connections are small compared with those of the fifth exemplary embodiment; however, by being provided with the configuration of the present disclosure, the liquid ejecting head can improve the electrical reliability thereof. Furthermore, the page wide liquid ejecting heads having the configurations illustrated in the fifth and sixth exemplary embodiments can be applied to liquid ejecting heads in which the liquid is circulated. Specifically, the above is a liquid ejecting head configured in such a manner that the liquid inside a pressure chamber, inside of which an element that generates energy used to eject the liquid is provided, is circulated between an external member. Since the flow amount of the liquid is relatively large and the operating time of the liquid ejecting head is relatively long in such a circulating-type page wide liquid ejecting head, application of the configuration of the present disclosure is especially preferable.

Seventh Exemplary Embodiment

Figure 19:
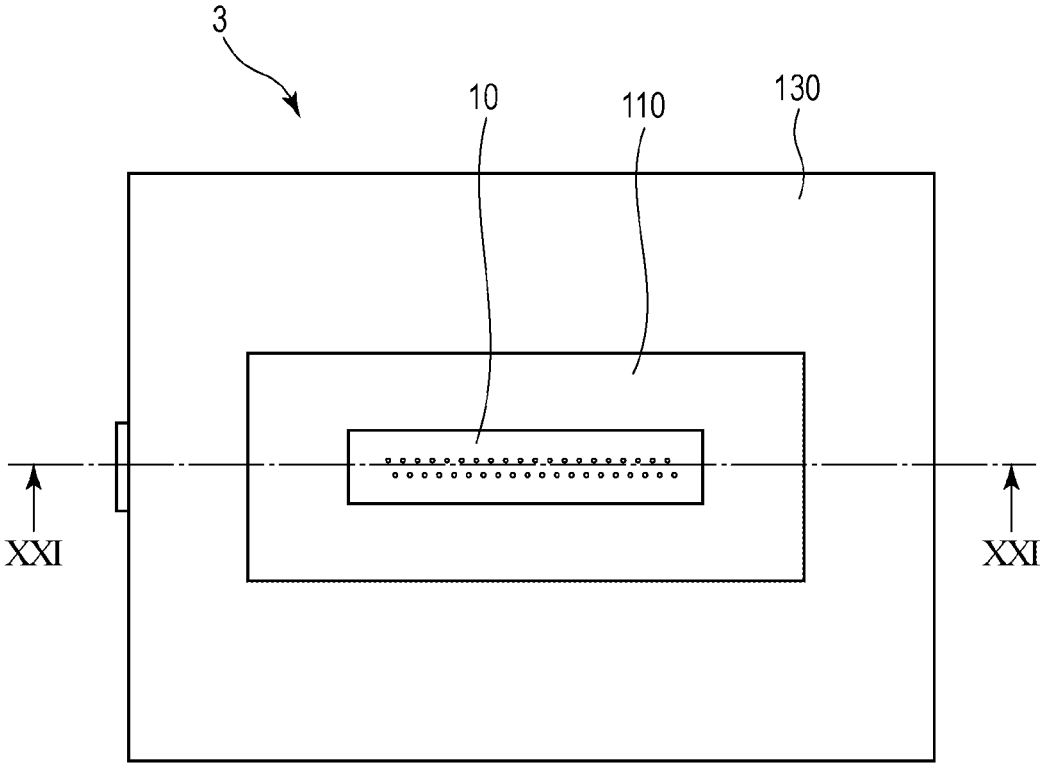
FIG. 19 is a top view illustrating a liquid ejecting head of a seventh exemplary embodiment.
Figure 20:
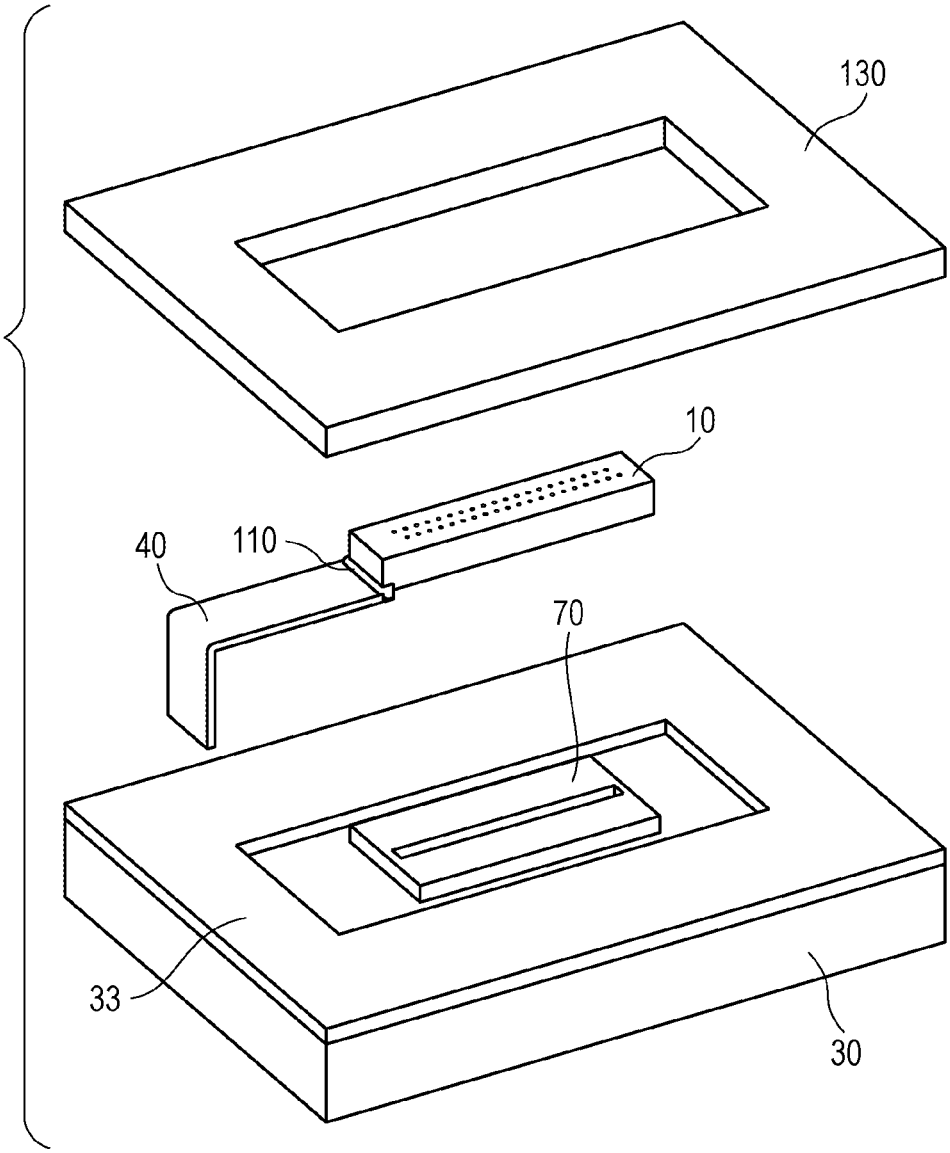
FIG. 20 is a perspective view of the liquid electing head of the seventh exemplary embodiment in a disassembled state.
Figure 21:
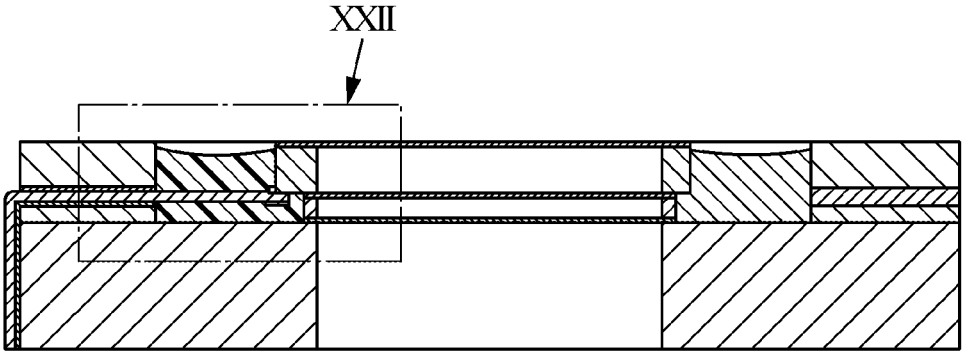
FIG. 21 is a cross-sectional view taken along line XXI-XXI in FIG. 19.
Figure 22:
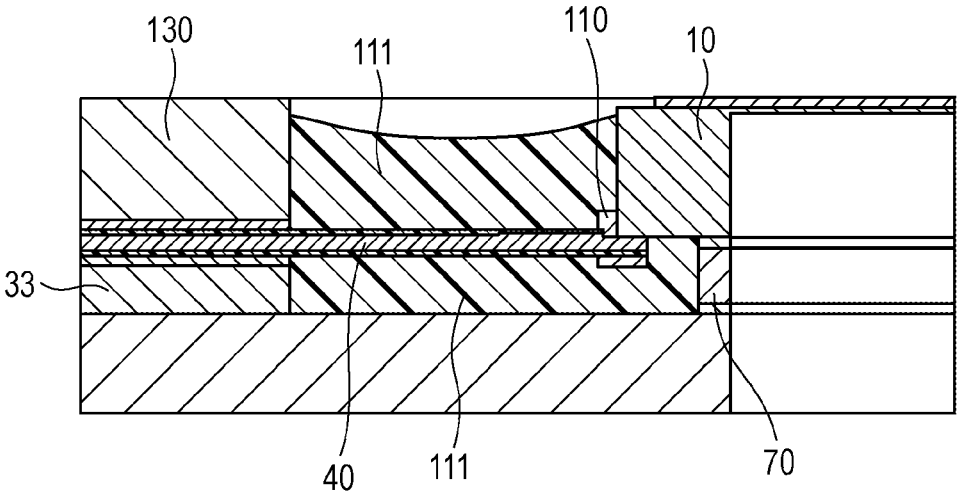
FIG. 22 is an enlarged view of a portion XXII in FIG. 21.

FIG. 19 is a top view of a liquid ejecting head for describing a liquid ejecting head of a seventh exemplary embodiment, and FIG. 20 is a perspective view of the liquid ejecting head in a disassembled state. Furthermore, FIG. 21 is a cross-sectional view taken along line XXI-XXI in FIG. 19, and FIG. 22 is an enlarged view of a portion XXII in FIG. 21.

The seventh exemplary embodiment has a configuration in which the print element substrate 10 including an electric connection on the back surface is used. As illustrated in FIG. 20, the print element substrate 10, the back surface of which the flexible wiring substrate 40 is electrically connected to and which is sealed with the first sealing material 110, is adhered and fixed on the support plate 70. Furthermore, the flexible wiring substrate 40 is adhered and fixed to the edge portion 33 of the support member 30. Moreover, the cover member 130 is adhered and fixed on the edge portion 33. Furthermore, as illustrated in FIG. 22, the second sealing material 111 is filled between the cover member 130 and the print element substrate 10 so that the flexible wiring substrate 40 on the ejection opening surface side and the electric connection of the flexible wiring substrate 40 are buried. With the present exemplary embodiment as well, the electrical reliability can be improved in a similar manner to that of the exemplary embodiments described above.

With the configuration described above, a configuration in which ink does not easily invade into an electric connection can be provided in a liquid ejecting head that uses a flexible wiring substrate and a thermosetting sealing material; accordingly, the electrical reliability can be improved.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2017-084780 filed Apr. 21, 2017, which is hereby incorporated by reference herein in its entirety.

What is claimed is:

1. A liquid ejecting head comprising:

a print element substrate including an ejection opening for ejecting a liquid;

a wiring member including wiring electrically connected to the print element substrate;

a connection electrically connecting the print element substrate to the wiring member;

a support member supporting the wiring member;

a sealing material sealing the connection; and a cover member having an opening through which the print element substrate is exposed and provided on the support member, wherein the wiring member is a strip-shaped member, and wherein a portion of the wiring member is provided on a supporting surface of the support member supporting the wiring member, and the portion of the wiring member includes a first portion that is sandwiched between the cover member and the support member and a second portion that is provided in the opening, and wherein the second portion is covered by the sealing material.

2. The liquid ejecting head according to claim 1, wherein the sealing material is provided in an area between the print element substrate and the cover member when viewed in a direction in which the liquid is ejected from the ejection opening.

3. The liquid ejecting head according to claim 2, wherein the sealing material includes a first sealing material that seals the connection, and a second sealing material that is provided in an area between the first sealing material and the cover member.

4. The liquid ejecting head according to claim 3, wherein the portion of the wiring member is covered by the first sealing material, the second sealing material, and the cover member.

5. The liquid ejecting head according to claim 3, wherein viscosity of the first sealing material is higher than that of the second sealing material.

6. The liquid ejecting head according to claim 3, wherein the first sealing material protrudes from a surface of the second sealing material.

7. The liquid ejecting head according to claim 1, wherein a groove, inside of which the sealing material is provided, is provided in a surface of the support member, and a portion around the electric wiring member is covered by the sealing material.

8. The liquid ejecting head according to claim 7, wherein a terminal electrically connected to a terminal provided in the print element substrate is provided on a first side of the wiring member in a longitudinal direction.

9. The liquid ejecting head according to claim 8, the terminal of the print element substrate is provided in a portion of an edge of the print element substrate that extends in a longitudinal direction of the print element substrate.

10. The liquid ejecting head according to claim 1, wherein the cover member is a plate-shaped member provided with an opening, and the print element substrate is disposed inside the opening.

11. The liquid ejecting head according to claim 1, wherein an entire surface of the portion of the wiring member is covered by the sealing material and the cover member.

12. The liquid ejecting head according to claim 1, wherein the wiring member is provided from a surface of the support member to a lateral surface adjacent to the surface of the support member.

13. The liquid ejecting head according to claim 1, wherein the support member is provided with a plurality of the print element substrates, and each of the print element substrates is provided with the wiring member.

14. The liquid ejecting head according to claim 13, wherein the print element substrates are arranged in a straight line.

15. The liquid ejecting head according to claim 13, wherein the print element substrates are disposed inside an opening of the cover member.

16. The liquid ejecting head according to claim 1, wherein the liquid ejecting head is a page wide liquid ejecting head having a length that corresponds to a width of a printing medium.

17. The liquid ejecting head according to claim 1 further comprising:

an element that generates energy used to eject the liquid; and a pressure chamber containing the element, wherein the liquid inside the pressure chamber is circulated external to the pressure chamber.

* * * * *